US008022906B2

(12) United States Patent
Yang

(10) Patent No.: US 8,022,906 B2
(45) Date of Patent: Sep. 20, 2011

(54) DRIVER FOR USE IN A FLAT PANEL DISPLAY ADAPTED TO DRIVE SEGMENT LINES USING A CURRENT

(75) Inventor: Jin-Seok Yang, Chungcheongbuk-do (KR)

(73) Assignee: Magnachip Semiconductor, Ltd. (KR)

( * ) Notice: Subject to any disclaimer, the term of this patent is extended or adjusted under 35 U.S.C. 154(b) by 861 days.

(21) Appl. No.: 11/072,205

(22) Filed: Mar. 3, 2005

(65) Prior Publication Data

US 2005/0248328 A1 Nov. 10, 2005

(30) Foreign Application Priority Data

May 4, 2004 (KR) ..... 10-2004-0031392

(51) Int. Cl.
*G09G 3/30* (2006.01)

(52) U.S. Cl. ..... 345/77

(58) Field of Classification Search ..... 345/74.1–86, 345/690, 204

See application file for complete search history.

(56) References Cited

U.S. PATENT DOCUMENTS

| | | | | |
|---|---|---|---|---|
| 5,138,310 | A * | 8/1992 | Hirane et al. | 345/82 |
| 5,539,334 | A * | 7/1996 | Clapp et al. | 326/68 |
| 6,040,827 | A * | 3/2000 | Shiina et al. | 345/208 |
| 6,147,665 | A * | 11/2000 | Friedman | 345/75.2 |
| 2002/0135424 | A1* | 9/2002 | Oikawa | 330/288 |
| 2002/0190974 | A1* | 12/2002 | Morita | 345/208 |
| 2003/0128202 | A1* | 7/2003 | Kim et al. | 345/212 |
| 2003/0184568 | A1* | 10/2003 | Date et al. | 345/690 |
| 2003/0234754 | A1* | 12/2003 | Abe et al. | 345/76 |
| 2004/0000949 | A1* | 1/2004 | Tsuchi | 330/253 |
| 2004/0008074 | A1* | 1/2004 | Takehara et al. | 327/524 |
| 2004/0032217 | A1* | 2/2004 | Abe et al. | 315/169.3 |
| 2004/0119666 | A1* | 6/2004 | Lim | 345/76 |
| 2004/0155840 | A1* | 8/2004 | Abe et al. | 345/76 |
| 2004/0160269 | A1* | 8/2004 | Tsuchi | 327/561 |
| 2004/0217934 | A1* | 11/2004 | Yang | 345/100 |
| 2005/0057457 | A1* | 3/2005 | Date | 345/76 |
| 2005/0168490 | A1* | 8/2005 | Takahara | 345/690 |

FOREIGN PATENT DOCUMENTS

| | | |
|---|---|---|
| JP | 2004-094237 | 3/2004 |
| KR | 2002-0042032 | 6/2002 |

* cited by examiner

*Primary Examiner* — Chanh Nguyen
*Assistant Examiner* — Robert Stone
(74) *Attorney, Agent, or Firm* — Blakely, Sokoloff, Taylor & Zafman

(57) ABSTRACT

A driver for use in a flat panel display, the driver adapted to drive segment lines by using a current, the current being generated by referring to a reference current outputted from a reference current source, the driver includes a driving block selector for selecting a reference current driving block to be activated according to a reference current value with respect to the reference current; and a plurality of reference current driving blocks for transferring the reference current value to a part where the segment lines are driven.

7 Claims, 5 Drawing Sheets

DRIVER FOR USE IN A FLAT PANEL DISPLAY ADAPTED TO DRIVE SEGMENT LINES USING A CURRENT

FIELD OF THE INVENTION

The present invention relates to a driver for outputting an image data as a corresponding current in a flat panel display; and, more particularly, to an OLED of an organic electroluminescence (EL) device.

DESCRIPTION OF RELATED ART

In a flat panel display, a luminescence is generally represented by a gradation and a luminance. The luminance means the intensity of light per unit area of a screen, and the gradation means the degree of brightness within a set luminance, which is displayed based on a video data inputted in pixel unit.

An organic electroluminescence (EL) is a self-luminous device, whose degree of emission is controlled in proportion to an amount of a supplied current. Therefore, in order to control the luminescence and gradation of the organic EL display, a current mirror is used to control a current driver, and an amount of a current outputted to pixels of the flat panel display is controlled using a method for controlling an average amount of a current by adjusting the switching intervals of the output lines.

FIG. 1 is a block diagram of a flat panel display using a general organic electroluminescent LED (OLED).

Referring to FIG. 1, the flat panel display using the OLED includes a display panel having a plurality of unit pixels xy arranged in matrix, a segment line controller for controlling segment lines, and a common line controller for controlling common lines.

The display panel includes a plurality of segment lines arranged in a longitudinal direction and a plurality of common lines arranged in a traverse direction. One unit pixel xy is arranged at every intersection of the segment lines and the common lines. Here, the segment line is called a source line and the common line is called a scan line.

The unit pixels formed at the intersections of the segment lines and the common lines are arranged in matrix, and one unit pixel xy consists of one OLED and one capacitor. One node of the OLED and one node of the capacitor are connected to one segment line, and the other node of the OLED and the other node of the capacitor are connected to one common line.

If a predetermined voltage is applied to the common line and a current is supplied through the segment line, the OLED emits a light. Accordingly, an output of an image data is carried out by selecting the common line and then supplying a current corresponding to a pixel data.

The driver for the flat panel display, which configures the segment line controller, is called a source driver. In the case of the organic EL device, the source driver is configured with a current driver that supplies a current identical to a reference current containing an output image data to each segment line. Output current driving stages corresponding one-to-one to the segment lines in the source driver is called channels.

With a high-quality display, the number of the segment lines and the common lines is increased. For the long common lines that transmit only a switching signal, the problem is negligible. However, for the segment lines that transmit the pixel data, the pixel data are difficult to transmit to the actual pixels as the number of the segment lines is increased.

When the driving output current corresponding to the same data is supplied to the segment lines, the current and voltage applied to the channels are different due to the resistance difference on the connection lines from the reference current source to the segment lines.

In order to solve the problem, there is proposed a method of reducing the number of channels that one reference current generator manages. That is, the number of channels that one reference current generator manages can be reduced by distributing a plurality of reference current generators in an entire chip. However, this method causes a chip area to increase. Therefore, the reduction of the chip area needs to trade off the channel drivability by using another improved method together.

Meanwhile, a current mirror can be used to match the driving currents of the respective channels. An example of a conventional current mirror is shown in FIG. 2, in which a current identical to a reference current is supplied to the source line channels.

The current mirror is implemented with a high-voltage PMOS transistor. Here, a current offset is removed by using a PMOS transistor higher than a PMOS transistor Mref11 disposed a diode-connected reference current source.

However, if the reference current increases in a high luminance/high gradation mode, a voltage difference between a drain and a gate of the reference transistor Mref11 becomes so large that a gate voltage (Vg1) decreases. A drop of the gate voltage (Vg1) of the output transistor Mn causes a voltage drop in a source of the output transistor Mn11, resulting in decreasing the output voltage (Vout1). That is, if the reference current is increased so as to increase the output current, the output voltage is decreased. Consequently, it is difficult to supply a sufficient power to the LED.

Specifically, since the reference transistor Mref11 is a high-voltage transistor having a small incremental amount of a current with respect to the voltage, the voltage drop of Vg1 is large, but a voltage rise due to the gate-source threshold voltage of the low-voltage output transistor is relatively slight.

In order to solve the problems, the present applicant has been proposed a driver for a flat panel display, which is disclosed in Korean Patent Application No. 2003-82601, filed by the present inventor.

The driver for the flat panel display drives the flat panel display by mirroring a reference current generated from a reference current block at a plurality of channels.

Referring to FIG. 3, the driver for the flat panel display includes a reference current block 110 and a plurality of channels 150. The reference current block 110 includes a first current mirror 130 configured with low-voltage MOS transistors. A reference current is generated from reference current source 112 and the first current mirror 130 receives a first mirroring current produced by mirroring the reference current through an input terminal. The first mirroring current flows through the first current mirror 130. A reference current region is allocated in the reference current block 110. The channels 150 are configured with high-voltage MOS transistors. The channels 150 include a second current mirror 151 that outputs a second mirroring current as an output signal. Here, the second mirroring current is produced by mirroring the first mirroring current.

According to the above-described invention, since the reference current and the driving current are not directly mirrored, the output voltage is not decreased even when the reference current is increased. Also, in the second current mirror 151, two high-voltage transistors Mph151 and Mph152 for the mirroring operation are arranged adjacent to the output channel position. Therefore, there is less possibility that a mismatch occurs due to a manufacturing process error of the mirroring transistors. In addition, since the first current mirror 130 is implemented with the low-voltage transistors having a low manufacturing process error, the current offset is reduced.

Although the low-voltage transistor occupies a small area and has a low process error, an operation area is small. Accordingly, there is a problem in that an input range of the reference current that the first current mirror can mirror is narrow.

SUMMARY OF THE INVENTION

It is, therefore, an object of the present invention to provide a driver for use in a flat panel display, capable of reducing a current offset due to a manufacturing process error.

It is another object of the present invention to provide a driver for use in a flat panel display, capable of supplying a sufficient voltage, that is, a high brightness intensity, to an output stage even in a high-current output mode.

It is a further another object of the present invention to provide a driver for use in a flat panel display, in which a wide range of a reference current can be applied.

In accordance with an aspect of the present invention, there is provided a driver for use in a flat panel display, which is adapted to drive segment lines by using a current, the current being generated by referring to a reference current outputted from a reference current source. The driver includes: a driving block selector for selecting a reference current driving block to be activated according to a reference current value with respect to the reference current; and a plurality of reference current driving blocks for transferring the reference current value to a part where the segment lines are driven.

Preferably, the reference current driving block includes a first current mirror for mirroring the reference current to generate a mirroring current, and the channel includes a second current mirror for mirroring the mirroring current to generate an output current.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE INVENTION

Hereinafter, the present invention will be described in detail with reference to the accompanying drawings.

Figure 4:
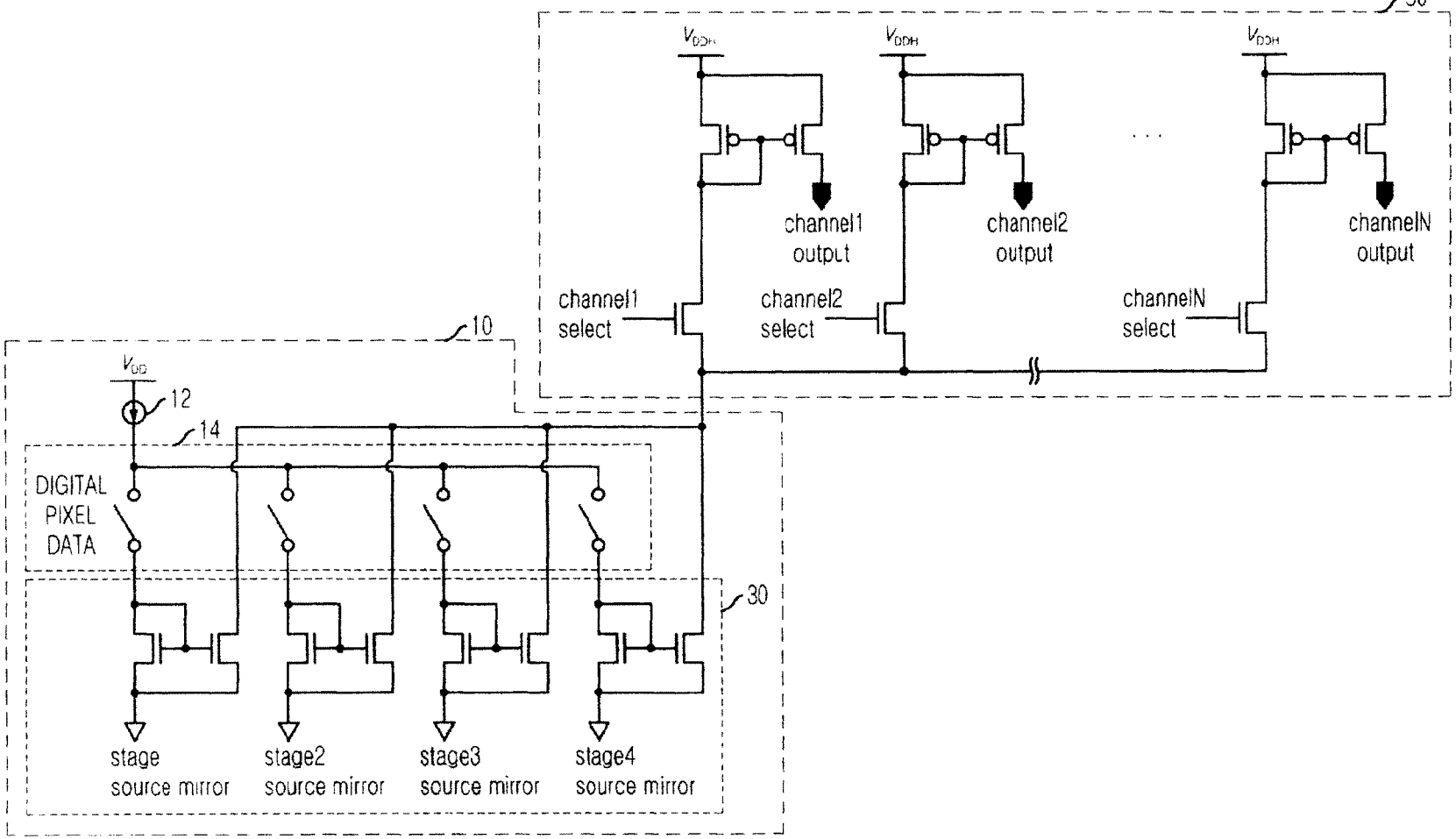
FIG. 4 is a circuit diagram of a conventional current mirror, in which a current is supplied to all segment lines shown in FIG. 1.
Figure 5:
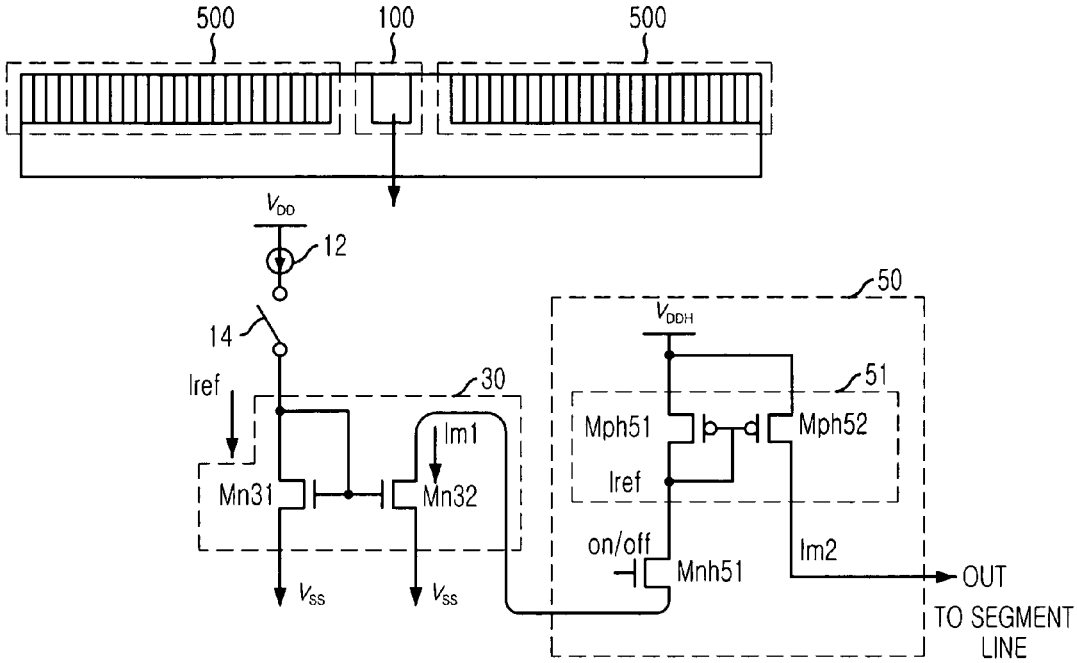
FIG. 5 is a circuit diagram of a current mirror in accordance with a preferred embodiment of the present, invention, in which a current is supplied to one segment line shown in FIG. 1.

FIGS. 4 and 5 are circuit diagrams of a driver for use in a flat panel display in accordance with a preferred embodiment of the present invention.

Referring to FIGS. 4 and 5, the driver for use in the flat panel display drives the flat panel display by mirroring a reference current at a plurality of channels. The driver includes a reference current source 12, driving block selectors 14, reference current driving blocks 30, and a plurality of channels 50.

The driving block selector 14 selects the reference current driving blocks to be activated according to an inputted reference current. Each of the reference current driving blocks 30 includes first current mirrors configured with low-voltage MOS transistors. The first current mirrors mirror the reference current inputted through the reference current input stage. The plurality of the channels 50 include second current mirrors configured with high-voltage MOS transistors. The second current mirrors mirror the mirroring current inputted through the selected reference current driving block and output it as an output signal.

Although the driver includes the plurality of the channels corresponding one-to-one with the respective segment lines of the panel, the present invention can be implemented with one channel commonly connected to all the segment lines. In this case, it is preferable to further include a segment line selector for selecting a segment line to transmit a channel output. The segment line selector can be implemented using a known technology. For example, the segment line selector can be implemented with a switch that switches the channel outputs and the segment lines.

The present invention can be applied to a driver for driving a flat panel display using an OLED.

Figure 1:
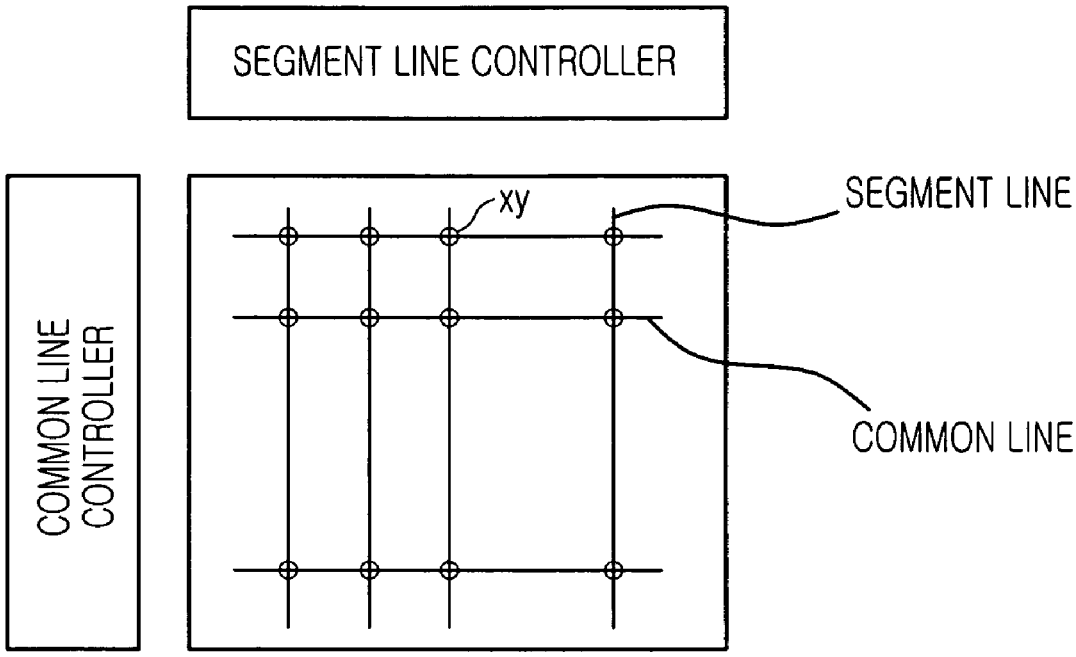
FIG. 1 (PRIOR ART)
FIG. 1 is a block diagram of a flat panel display using a general organic electroluminescence (EL)
Figure 2:
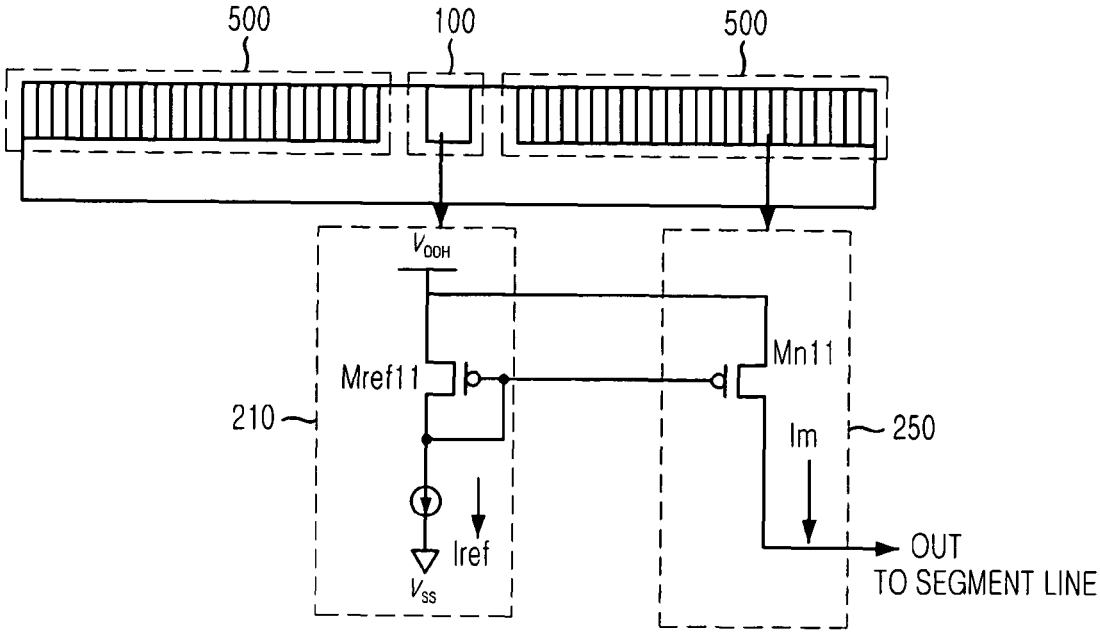
FIG. 2 (PRIOR ART)
FIG. 2 is a circuit diagram of a conventional current mirror, in which a current is supplied to one segment line shown in FIG. 1.
Figure 3:
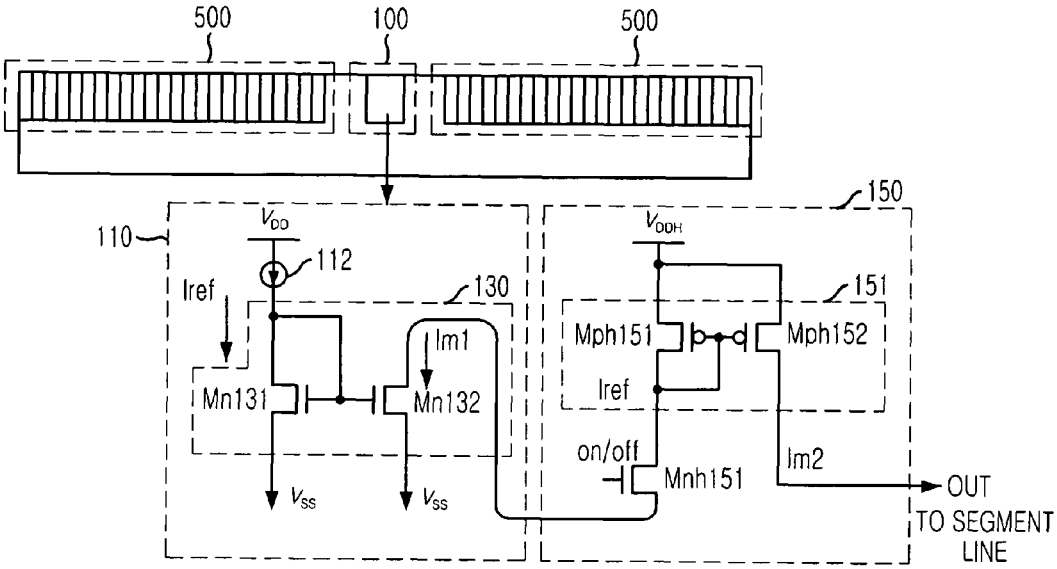
FIG. 3 (PRIOR ART)
FIG. 3 is a circuit diagram of another conventional current mirror, in which a current is supplied to one segment line shown in FIG. 1.

An entire structure of the driver is shown in FIG. 4, and one reference current driving block and one channel are shown in FIG. 5. A part where one reference current driving block and one channel are shown is similar to the prior art shown in FIG. 3.

The reference current source 12 generates a current corresponding to a brightness intensity of an inputted pixel data. Since the inputted pixel data is a digital data and an output of the reference current source is an analog signal, a digital-to-analog converter (DAC) must be provided. However, since the digital-to-analog conversion is apparent to those skilled in the art, a description thereof will be omitted.

In one embodiment, one reference current driving block 30 includes a first current mirror configured with a pair of low-voltage NMOS transistors. The first current mirror is configured with a first NMOS transistor Mn31 having a drain receiving the reference current, a gate connected to the drain, and a source grounded, and a second NMOS transistor Mn32 having a gate connected to the gate of the first NMOS transistor Mn31, a source grounded, and a drain outputting a mirroring current Im1.

In one embodiment, one channel 50 includes a second mirror configured with a pair of high-voltage PMOS transistors. The second current mirror is configured with a first PMOS transistor Mph51 and a second PMOS transistor Mph51. The first PMOS transistor Mph51 has a source connected to a high voltage, a gate connected to the drain, and a drain receiving the mirroring current Im1. The second PMOS transistor Mph52 has a source connected to the high voltage, a gate connected to the gate of the first PMOS transistor Mph51, and a drain outputting an output current.

Here, the low-voltage device is a MOS transistor designed to be driven only at a relatively low voltage (for example, 2.5-3 V) environment, and the high-voltage device is a MOS transistor designed to be driven at both a relatively low voltage environment and a relative high voltage (for example, about 18 V) environment. The transistors have the low voltage characteristic and the high voltage characteristic by controlling the ratio of channel width to channel length in manufacturing the MOS transistors.

Although the high-voltage device has advantages in that an operating range is wide and a large amount of power can be supplied to the output terminal, it has disadvantages in that it occupies a large area on a semiconductor substrate and a manufacturing process error is large.

A driver for driving the organic EL panel receives a digital image and a control signal and activates a scan line, and then generates an output current corresponding to the pixel data to the segment line one by one. The driver includes a structure for driving the reference current with respect to the pixel data, and a structure for driving the output current in one-to-one correspondence with the segment lines.

In general, a reference substrate area 100 for the elements for driving the reference current is disposed at the center of the semiconductor substrate. The elements for driving the output current to the segment lines are disposed at a channel substrate area 500 adjacent to the reference substrate area 100. In one embodiment, the reference current driving blocks 30 and the reference current selectors 14 are formed on the reference substrate area 100, and the channels 50 are formed on the channel substrate area 500.

The reference current driving blocks 30 for generating the reference current supplied to the channels can be configured with the low-voltage devices. The low-voltage devices occupy a smaller area than the high-voltage devices. Therefore, the operating range can be extended by forming the plurality of the reference current driving blocks on the reference substrate area 100 where the high-voltage devices are placed in the prior art.

Only one of the multi-stage reference current driving blocks 30 must be driven. This can be possible by making the driving block selector 14 select one reference current driving block according to the current supplied from the reference current source.

An image data used in a personal computer (PC) or the like is a digital data, and the driver carries out the digital-to-analog conversion on the image data to thereby convert it into the reference current value. Accordingly, although the driving block selector 14 can be implemented to determine the reference current and turn on the corresponding reference current driving block, it is preferable to select the reference current driving block by using the digital pixel data value, which is an input data with respect to a driver chip. The selection of the reference current driving block is achieved by grouping the range of the digital pixel data value into a predetermined number and transmitting a turn-on signal to the designated driving block selector when a digital value of the grouped range is inputted. The range of the inputted digital value is wider than that of the outputted digital value. The inputted digital values are grouped into a predetermined number (the range of the output value) and one output value is assigned to one group. Since this process can be implemented with a known technology, such as the use of multiplexer (MUX), a description thereof will be omitted.

In one embodiment, a channel switch part for selecting the channel to be activated can be further included. The channel switch part selects the segment to be driven among the segment lines that share the activated scan lines. The channel switch part includes a MOS transistor Mnh51 having a gate receiving an on/off control signal, a drain connected to the drains of the first and second PMOS transistors of the second current mirror, a source connected to the input terminal of the first current mirror. Here, it is preferable that, the MOS transistor Mnh51 is configured with the high voltage device.

Hereinafter, an operation of the driver for use in the flat panel display will be described with reference to FIGS. 4 and 5.

The case where the channel switch part is further included corresponds to the case where the channel is selected and thus the switch is turned on, so that it is identical to the case where there is no channel switch part.

A digital image data is inputted to the driver. Then, the driver determines the pulse width to drive the scan line according to the luminance and gradation, and/or the magnitude of the current to be outputted to the segment lines. During the process of determining the magnitude of the current (the reference current value), the driving block selector 14 selects the reference current driving block suitable for the driving operation.

If the scan line is activated, the reference current is generated from the reference current source 12 of the driver. The reference current is inputted to the selected reference current driving block 30.

If the reference current flows from the power supply voltage VDD to the ground voltage within the selected reference current driving block 30, the first and second NMOS transistors Mn31 and Mn32 of the first current mirror are turned on, and the first mirroring current Im1 produced by mirroring the reference current is generated through the second NMOS transistor Mn32.

The channel switch Mnh51 is provided to activate only the channel corresponding to the position for displaying the pixel. If the first mirroring current Im1 flows through a channel input PMOS transistor Mph51 of the channel 51 selected by the channel switch Mnh51, the segment driving PMOS transistor Mph52 is also turned on and the second mirroring current Im2 is generated. As described above, the second mirroring current Im2 is an output signal for the driver of the flat panel display and it is supplied as the current to one segment line of the flat panel display using the OLED.

Although the reference current area is configured with two NMOS transistors, other elements can be further included.

Also, although it has been described that the corresponding current is inputted/outputted from the reference current source to the reference current driving block, from the reference current driving block to the channel, and from the channel to the segment line, the input of the current may be a sink and the output of the current may be a source, and vice versa.

In accordance with the present invention, the driver for use in the flat panel display can supply a sufficient power to the corresponding segment lines and can also prevent the mismatch of the mirror transistors by implementing the channel driving current mirror with the transistors having the same specification as the adjacent transistors.

The present application contains subject matter related to Korean patent application No. 2004-31392, filed in the Korean Patent Office on May 4, 2004, the entire contents of which being incorporated herein by reference.

While the present invention has been described with respect to the particular embodiments, it will be apparent to those skilled in the art that various changes and modifications may be made without departing from the spirit and scope of the invention as defined in the following claims.

What is claimed is:

1. A driver for use in a flat panel display comprising:

a plurality of reference current driving blocks, each of the reference current driving blocks including a first current mirror that comprises a pair of low-voltage NMOS transistors for generating a first mirroring current by mirroring a reference current output from a reference current source;

a plurality of driving block selectors for selecting one pair of the low-voltage NMOS transistors in one of the reference current driving blocks to be activated according to a turn-on signal, and for transferring the reference current to the selected reference current driving block, wherein the turn-on signal is generated by grouping a range of digital pixel data into a predetermined number, and the turn-on signal is transmitted to a designated driving block selector when a digital value of the grouped range is inputted; and at least one channel, each channel including a second current mirror that comprises high-voltage PMOS transistors, wherein the first mirroring current flows from a corresponding one of the low-voltage NMOS transistors to a corresponding one of the high-voltage PMOS transistors to generate a second mirroring current, and at least one channel switch coupled between the first and second current mirrors to select a segment line from among a plurality of segment lines, wherein the low-voltage NMOS transistors occupy a smaller area than the high-voltage PMOS transistors, wherein the reference current driving blocks and the driving block selectors are formed on a reference substrate area disposed at a center of a segment line controller, and the channel is formed on a channel substrate area located at both sides of the reference substrate area, wherein a high-voltage PMOS transistor has a small incremental amount of a current with respect to the voltage, and wherein a low-voltage NMOS transistor has a large incremental amount of a current with respect to the voltage.

2. The driver as recited in claim 1, wherein the driving block selector receives a digital value of a pixel data, which is prior to a conversion into the reference current value, and selects one of the reference current driving blocks.

3. The driver as recited in claim 1, wherein the low-voltage NMOS transistors operate in a range from approximately 2.5 V to approximately 3.0 V.

4. The driver as recited in claim 1, wherein the high-voltage PMOS transistors operate in a range of approximately 18 V.

5. The driver as recited in claim 1, wherein the first current minor includes:

a first NMOS transistor having a drain receiving the reference current, a gate connected to the drain, and a source grounded; and a second NMOS transistor having a gate connected to the gate of the first NMOS transistor, a source grounded, and a drain outputting the first minoring current.

6. The driver as recited in claim 1, wherein the second current mirror includes:

a first PMOS transistor having a source connected to a high voltage, a drain receiving the first mirroring current, and a gate connected to the drain; and a second PMOS transistor having a source connected to the high voltage, a gate connected to the gate of the first PMOS transistor, and a drain outputting the second mirroring current.

7. The driver as recited in claim 1, the channel switch includes a channel switching transistor having a gate receiving an on/off control signal, a drain coupled to the second current mirror, and a source coupled to the first current mirror.

* * * * *

UNITED STATES PATENT AND TRADEMARK OFFICE

CERTIFICATE OF CORRECTION

PATENT NO. : 8,022,906 B2
APPLICATION NO. : 11/072205
DATED : September 20, 2011
INVENTOR(S) : Yong-Sik Jeong It is certified that error appears in the above-identified patent and that said Letters Patent is hereby corrected as shown below:

In the Claims, Column 8, line 19, please delete “minoring” and insert --mirroring--.

Signed and Sealed this
Fourteenth Day of February, 2012

David J. Kappos

David J. Kappos
*Director of the United States Patent and Trademark Office*